US005349795A

United States Patent [19]

French et al.

[11] Patent Number: 5,349,795

[45] Date of Patent: Sep. 27, 1994

[54] WIDTH-ADJUSTABLE STAIRWAY STEP TREAD AND METHOD FOR CONSTRUCTING A STAIRWAY THEREWITH

[76] Inventors: Terry L. French, 13462 Lakeshore Dr., Grand Haven, Mich. 49417; Steven C. Johnson, 16329 Hemlock, Spring Lake, Mich. 49456

[21] Appl. No.: 25,860

[22] Filed: Mar. 3, 1993

[51] Int. Cl.[5] ..... E04F 11/00

[52] U.S. Cl. ..... 52/183; 52/188

[58] Field of Search ..... 52/183, 182, 188, 190; 182/194, 223

[56] References Cited

U.S. PATENT DOCUMENTS

| | | | |
|---|---|---|---|
| 1,116,073 | 11/1914 | Johnson et al. . | |
| 1,823,509 | 9/1931 | Peters et al. . | |
| 1,960,863 | 5/1934 | Boyer . | |
| 2,103,603 | 12/1937 | Voigt . | |
| 2,266,274 | 12/1941 | Schroeder . | |
| 2,377,994 | 6/1945 | Cocken | 52/182 |
| 2,585,150 | 2/1952 | McGill . | |
| 2,599,976 | 6/1952 | Carlson . | |
| 2,805,104 | 9/1957 | Johnson . | |
| 2,820,687 | 1/1958 | Waring . | |
| 2,830,706 | 4/1958 | Canning . | |
| 2,852,785 | 9/1988 | Mikola | 182/223 X |
| 2,899,011 | 8/1959 | Babits . | |
| 2,941,617 | 6/1960 | Stiffler . | |
| 3,099,336 | 7/1963 | Hawkins | 52/182 |
| 3,282,378 | 11/1966 | Pierce . | |
| 3,380,697 | 4/1968 | Melcher . | |
| 3,648,626 | 3/1972 | Schuster . | |
| 3,698,329 | 10/1972 | Diamond et al. . | |
| 3,985,204 | 10/1976 | Lattig . | |
| 4,289,215 | 9/1981 | Robinson . | |
| 4,605,097 | 8/1986 | Maxwell . | |
| 4,749,191 | 6/1988 | Gipson et al. . | |
| 5,060,757 | 10/1991 | Wyche . | |

FOREIGN PATENT DOCUMENTS

| | | | |
|---|---|---|---|
| 2615049 | 10/1977 | Fed. Rep. of Germany | 52/182 |
| 2707547 | 1/1979 | Fed. Rep. of Germany . | |
| 1211973 | 3/1960 | France . | |

*Primary Examiner*—Carl D. Friedman
*Assistant Examiner*—Robert J. Canfield
*Attorney, Agent, or Firm*—Price, Henevel, Cooper, DeWitt & Litton

[57] ABSTRACT

A width-adjustable step tread has first and second members, each extending along at least an appendage of a width of the step tread. Each of the first and second members have identical cross-sectional shapes as defined by a web with two opposing edges. A first appendage extends along one edge of the web defining an exterior surface and a second appendage extends along the other edge of the web defining an interior surface. The interior surface of the second appendage forms a female part which receives a male part formed by the exterior surface of the first appendage so that the first appendage of each member couples in sliding engagement with the second appendage of the other member.

12 Claims, 2 Drawing Sheets

WIDTH-ADJUSTABLE STAIRWAY STEP TREAD AND METHOD FOR CONSTRUCTING A STAIRWAY THEREWITH

BACKGROUND OF THE INVENTION

The present invention relates generally to stairway devices and, more particularly, to step treads and the like.

During new construction or remodeling of multiple level buildings, for example, a temporary stairway may be installed and used until such time as a finished stairway may be installed without probable risk of subsequent damage from the construction activity. The step treads of such temporary stairways are commonly fabricated from scrap construction materials, including, but not limited to, structural sheet goods like plywood and oriented strand board and structural framing materials like two-by-fours and two-by-sixes. However, these scrap materials are often not intended for step tread use, and the resulting temporary tread is commonly structurally inadequate or otherwise unsafe.

Locally enforced building codes specify minimum requirements for stairways, including minimum tread depth and maximum rise height. The Building Officials and Code Administrators (BOCA) national building code for 1991 and 1993, for example, specifies a maximum rise height of 7 inches and a minimum tread depth of 11 inches with an exception for residential construction, wherein a maximum rise height of 8 ¼ inches and a minimum tread depth of 9 inches is required. Clearly, the use of scrap materials to construct temporary stair treads can easily take the stairway outside of code requirements. A set of three two-by-fours with a dimensional depth of 3 ¼ inches will fall short of the minimum required 11 inch tread depth for general construction by 1 ¼ inches, while the combination of a two-by-four and a two-by-six (5 ¼ inches dimensional depth) will fall short of the residential minimum tread depth of 9 inches by ½ inch. Further, the stringers used for construction of a temporary stairway will commonly be used for the finished stairway. Thus, if the finished stair tread material has a dimensional thickness of one inch, for example, the use of two inch framing lumber can easily exceed the maximum allowed riser height.

Builders may use scrap materials for temporary stairway treads to minimize costs and maximize material utilization. However, such perceived savings may, in fact, be lost to work site accidents and resulting safety costs. Thus, there is a clear need for a cost-effective and safe stairway step tread which may be used for temporary stairway construction.

SUMMARY OF THE INVENTION

The problems and concerns discussed above are addressed and resolved by the clever, width-adjustable tread of the present invention.

A width-adjustable tread according to the present invention has first and second members, each extending along at least a portion of the width of the tread and having identical cross-sectional shapes. The cross-sectional shape of each tread member is adapted or configured for interlocking engagement of the first and second members so that the members couple in sliding engagement with one another in a width-wise direction.

In one aspect of the invention, the first and second members are made from one extruded piece of metal cut into equal lengths and having a cross-sectional shape defined by a web having two opposing edges with a first appendage extending along one of the two opposing edges, defining a male part having an exterior surface, and a second appendage extending along the other of the two opposing edges, defining a female part, the interior surface of which corresponds to the exterior surface of the male member.

In a further aspect of the invention, the first appendage includes a flange which extends in a first direction, away from the web, to the male part. Further, the second appendage includes a flange extending in a second direction, generally opposite the first direction of the first appendage flange, away from the web, to the female part. Further yet, the female part of the second appendage of the first tread member, when properly oriented, is adapted to at least partially wrap around the male part of the second tread member and vice versa. The first appendage of each member may have a part with a thickness greater than a thickness of the web.

Thus, in accordance with the above structure, an adjustable stairway tread is provided that is constructed of one extruded or molded length of material which can be cut to provide any number of first and second telescoping members to form a temporary stairway step that can be used at various construction sites.

These and other objects, advantages, and features of the present invention will become apparent upon review of the the following specification in conjunction with the drawings.

DESCRIPTION OF THE PREFERRED EMBODIMENT

Figure 1:
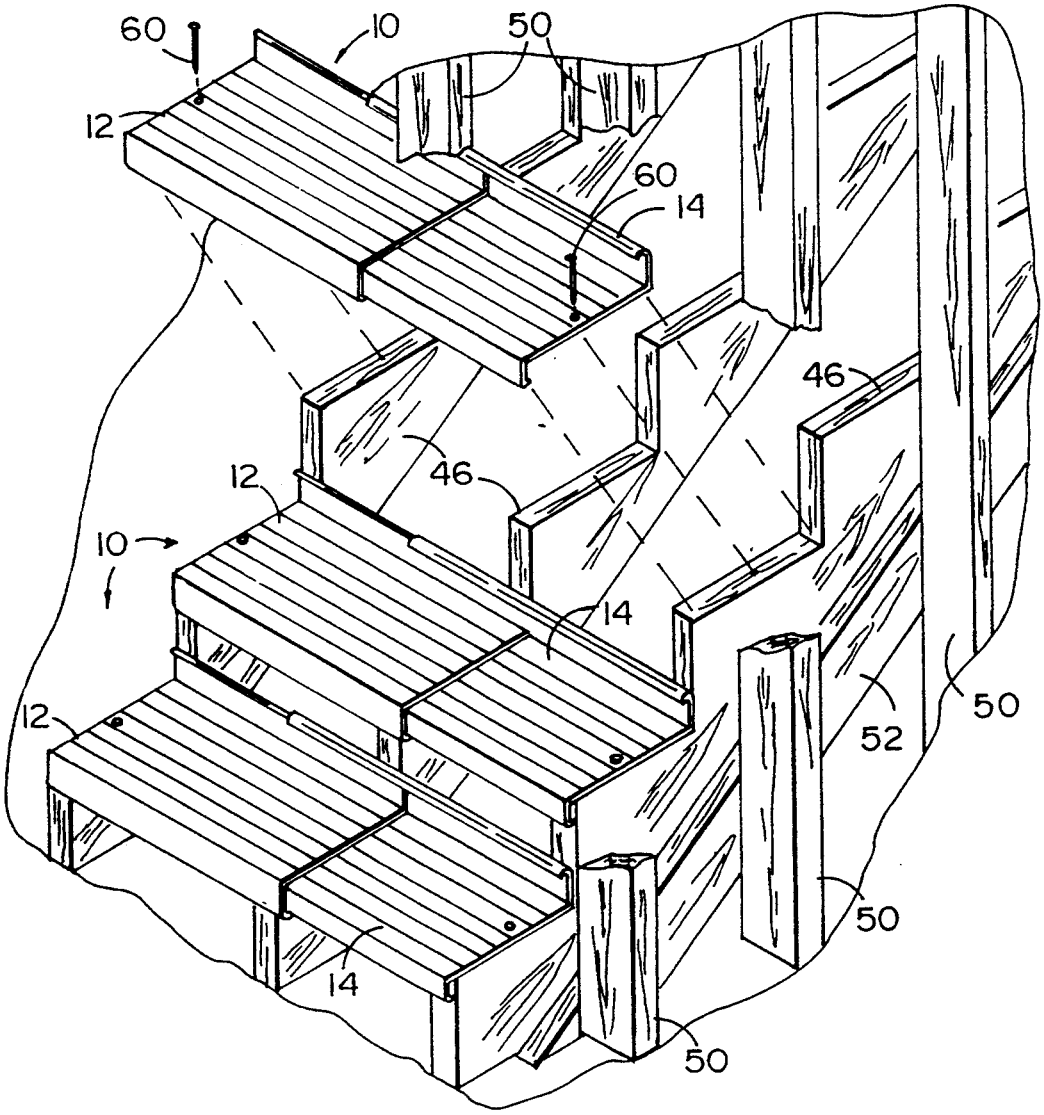
FIG. 1 is a partially exploded, partially cut away perspective view of a stairway incorporating width-adjustable treads according to the present invention.

Now referring to the drawing figures in greater detail, a width-adjustable tread according to the present invention is generally designated in the drawing figures by the reference number 10. Tread 10 has a first member 12 and a second member 14 which couple in sliding engagement in a width-wise direction (FIGS. 2 and 6).

Figure 3:
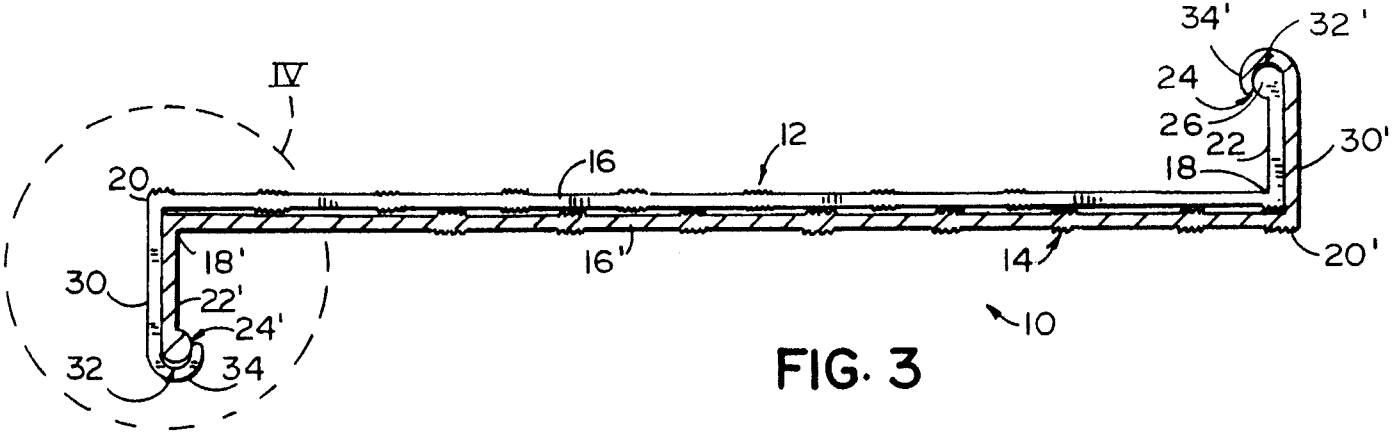
FIG. 3 is a cross-sectional view taken along line III—III of FIG. 2.
Figure 4:
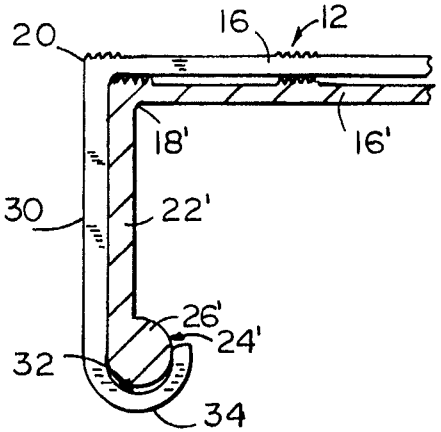
FIG. 4 is an enlarged detail of FIG. 3.

First member 12 is an elongated member defined by a web 16 having opposing edges 18 and 20 (FIGS. 3 and 4). A first appendage or flange 22 extends along edge 18 of web 16, defining a male part 24 having an exterior surface. Flange 22 extends in a first direction, most preferably generally perpendicular to web 16, away from web 16, at edge 18, to a terminal end 26, most preferably having a thickness greater than a thickness of flange 22 or of web 16.

A second appendage or flange 30 extends along the outer edge 20 of web 16, defining a female part 32 having an interior surface corresponding to the exterior surface of male part 24. Flange 30 extends in a second direction, generally opposite flange 22 and most preferably generally perpendicular to web 16, away from web 16, at edge 20, to a terminal end 34.

Figure 2:
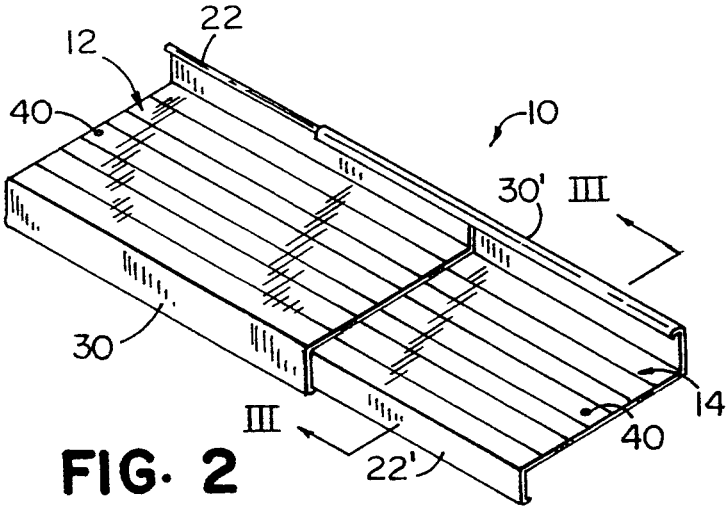
FIG. 2 is a perspective view of one of the treads of FIG. 1.

Second member 14 is an elongated member identical to first member 12 (FIGS. 2–4). Second member 14 has a web 16' with opposing edges 18' and 20'. A first appendage or flange 22' extends along edge 18' of web 16' defining a male part 24' having an exterior surface. Flange 22' extends in a first direction, most preferably generally perpendicular to web 16', away from web 16', at edge 18' to a terminal end 26' most preferably having a thickness greater than a thickness of flange 22' or of web 16'.

A second appendage or flange 30' extends along the other edge 20' of web 16' defining a female part 32' having an interior surface corresponding to the exterior surface of male part 24'. Flange 30' extends in a second direction, generally opposite flange 22' and most preferably generally perpendicular to web 16' away from web 16' at edge 20' to a terminal end 34'.

First member 12 and second member 14 are effectively produced as lengths cut from the same extruded or molded structural shape or piece of material. The members are preferably made from an extruded metal material including, but not limited to, steel or aluminum alloy, for example. The extrusion or molded piece may also be made from any appropriate structural plastic.

Figure 5:
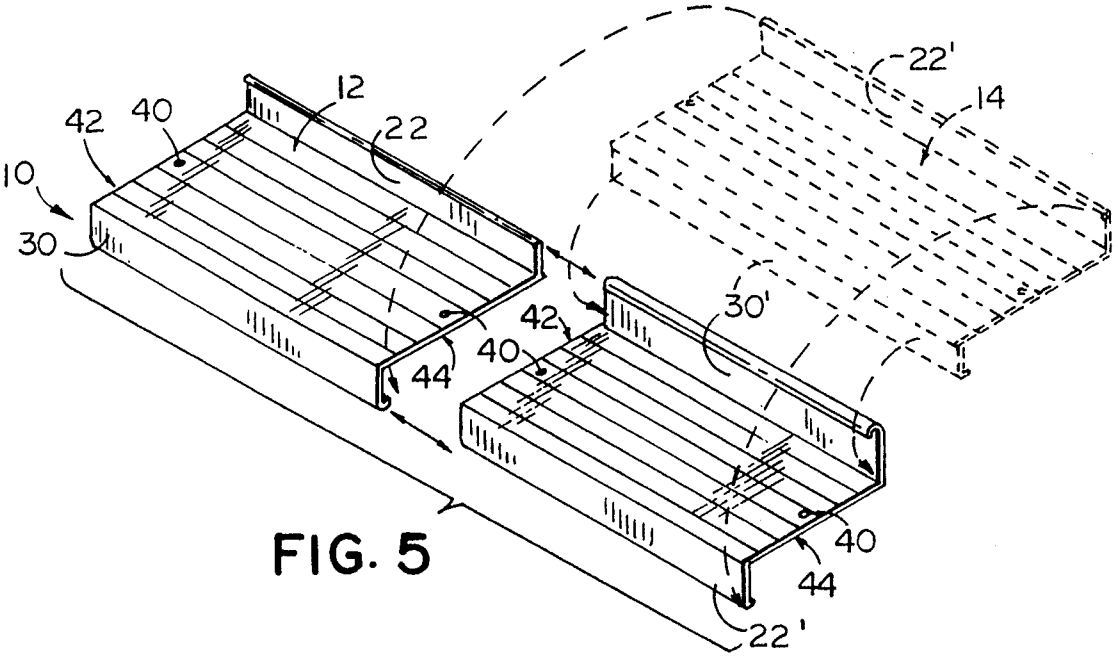
FIG. 5 is an exploded perspective view of the tread showing the two members of the tread and edge-for-edge rotation of one member for coupling with the other member.

First member 12 and second member 14 may be cut from the extruded structural shape by shearing or by other commonly known methods appropriate for the specific material used. By flipping member 14, for example, edge-for-edge relative to member 12 (FIGS. 5 and 6), the members can be oriented and telescoped together to interlock flange 22 of member 12 with flange 30' of member 14 and flange 30 of member 12 with flange 22' of member 14. Thus, member 12 and member 14 are coupled in sliding engagement in a width-wise direction. It will be noted that web 16, flange 22, and flange 30 are identical to web 16' flange 22' and flange 30' respectively, since members 12 and 14 are formed from the same extruded or molded piece.

Referring specifically to FIG. 3, it will be noted that terminal end 34 of flange 30 most preferably wraps at least partially around terminal end 26' of flange 22' to effectively capture flange 22' in sliding engagement (FIG. 4). Likewise, terminal end 34' wraps at least partially around terminal end 26. Thus, male part 24 slidably fits into female part 32' while male part 24' slidably fits into female part 32.

Each of first member 12 and second member 14 is provided with a mounting aperture 40 generally centered along the depth of web 16 near each of two opposing ends 42 and 44 of web 16 (FIGS. 1 and 6). As shown in FIG. 1, mounting apertures 40 facilitate the installation of tread 10 to stringers 46 of a stairway 48 with fasteners 60, which may be screws or nails or the like. When nailing, commonly available duplex or double-headed nails are preferably used for temporary use of tread 10. Although, single-headed nails may also be used and are most easily removed if the nail head is not set tightly against, but left spaced at least slightly from web 16.

OPERATION

In accordance with this invention, the width-adjustable tread 10 is utilized in a method of constructing a stairway. As is disclosed in FIG. 1, the stairway is constructed by first providing a plurality of studs 50 spaced a desired distance from each other, corresponding to the width of the ultimate stairway. Side stringers 46 are mounted to the studs 50 and 51 and in many instances, a center stringer 46 is provided depending upon the width of the stairway. The greater the width, the more essential is the central stringer. Further, a spacer 52 may be positioned between an outer or side stringer 46 and studs 50 to provide space for drywall or other wall surfacing material.

A plurality of width-adjustable treads 10 are provided for the stairway depending upon the number of steps. The width of each tread 10 is adjusted by sliding the two members 12 and 14 relative to each other to span at least the distance between the outer or side stringers 46. Each tread 10 is then easily fastened in place by driving fasteners 60 through apertures 40 into the side stringers 46.

This provides a temporary stairway that is strong and is easily and quickly installed. Thus, it conserves labor and produces a safer temporary stairway. In many instances, telescoping treads 10 also eliminate the use of good boards by eliminating the need to cut these boards to lengths the width of the stairway, and subsequent waste of such boards.

At an appropriate time during the construction of the building, the fasteners 60 are removed, permitting the removal of the treads 10, and a finished tread such as a one-inch particle board or one-inch oak or pine is substituted for the treads 10 which are reusable in subsequent construction of buildings.

While those who practice this invention, through manufacture, sale, or use or otherwise, will realize that flanges 22, 30, 22', and 30' may be configured in a variety of different shapes, other than the flanges specifically shown and described, and still provide the clever interconnection of first member 12 with second member 14, discussed in greater detail above, it will be noted that flanges 22, 30, 22', and 30' as shown and described above add the further benefit of stiffening webs 16 and 16' to provide tread 10 with great load bearing capacity. In addition, the flanges provide for a first stop at a front edge of tread 10, to fit over the vertical edges of the stringers 46, and a second stop at a back edge of the tread 10.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A stairway comprising:

at least a first stringer and a second stringer oriented in generally parallel spaced relative to one another, said stringers defining a length of said stairway; and a series of treads spaced along said length, each tread of said series having an adjustable width and extending at least between said first and second stringers, each said tread further having:

a first member extending along at least a portion of said width, said first member having a first cross-sectional shape; and a second member extending along a portion greater than a remaining portion of said width, said second member having a second cross-sectional shape, said second cross-sectional shape being identical to said first cross-sectional shape, but rotated edge-to-edge in inverted orientation relative to said first cross-sectional shape, said first cross-sectional shape and said second cross-sectional shape being adapted to couple in interlocking engagement of said first member with said second member whereby said first and second members are coupled to define a range of widths of said tread.

2. A stairway comprising:

at least a first stringer and a second stringer oriented in generally parallel spaced relation relative to one another, said stringers defining a length of said stairway; and a series of treads spaced along said length, each tread of said series having an adjustable width and extending at least between said first and second stringers, each said tread further having:

a first member extending along at least a portion of said width, said first member having a first cross-sectional shape; and a second member extending along a portion greater than a remaining portion of said width, said second member having a second cross-sectional shape substantially identical to said first cross-sectional shape, said first cross-sectional shape and said second cross-sectional shape being adapted to couple in interlocking engagement of said first member with said second member whereby said first and second members are coupled in sliding engagement in a width-wise direction;

each of said first member and said second member including:

a web with two opposing edges;

a first appendage extending along one of said two opposing edges, said first appendage defining an exterior surface; and a second appendage extending along the other of said two opposing edges, said second appendage defining an interior surface corresponding to said exterior surface whereby said first appendage of said first member couples in sliding engagement with said second appendage of said second member and said second appendage of said first member couples in sliding engagement with said first appendage of said second member.

3. The stairway defined in claim 2 wherein said first appendage is a flange extending in a first direction, away from said web, at said one edge, to a terminal end.

4. The stairway defined in claim 3 wherein said second appendage is a flange extending in a second direction, generally opposite said first direction, away from said web, at said other edge, to a terminal end, said second appendage terminal end of one of said first member and said second member wrapping at least partially around said first appendage terminal end of the other of said first member and said second member.

5. The stairway defined in claim 4 wherein said first appendage terminal end has a male part and said second appendage terminal end has a female part, said female part of each of said first member and said second member receiving said male part of the other of said first member and said second member.

6. The stairway defined in claim 2 wherein said first appendage has a male part and said second appendage has a female part, said female part of each of said first member and said second member receiving said male part of the other of said first member and said second member.

7. A width-adjustable stairway step tread comprising:

a first member extending along at least a portion of a width of said step tread, said first member having a first cross-sectional shape; and a second member extending along a portion greater than a remaining portion of the width of said step tread, said second member having a second cross-sectional shape, said second cross-sectional shape being identical to said first cross-sectional shape, but rotated edge-to-edge in inverted orientation relative to said first cross-sectional shape, each of said first cross-sectional shape and said second cross-sectional shape being adapted to couple in interlocking engagement of said first member with said second member whereby said first and second members couple to define a range of widths of said tread.

8. A width-adjustable stairway step tread comprising:

a first member extending along at least a portion of a width of said step tread, said first member having a first cross-sectional shape; and a second member extending along a portion greater than a remaining portion of the width of said step tread, said second member having a second cross-sectional shape substantially identical to said first cross-sectional shape, each of said first cross-sectional shape and said second cross-sectional shape being adapted to couple in interlocking engagement of said first member with said second member whereby said first and second members couple in sliding engagement in a width-wise direction;

each of said first member and said second member including:

a web with two opposing edges;

a first appendage extending along one of said two opposing edges, said first appendage defining an exterior surface; and a second appendage extending along the other of said two opposing edges, said second appendage defining an interior surface corresponding to said exterior surface whereby said first appendage of said first member couples in sliding engagement with said second appendage of said second member and said second appendage of said first member couples in sliding engagement with said first appendage of said second member.

9. The stairway step tread defined in claim 8 wherein said first appendage is a flange extending in a first direction, away from said web, at said one edge, to a terminal end.

10. The stairway step tread defined in claim 9 wherein said second appendage is a flange extending in a second direction, generally opposite said first direction, away from said web, at said other edge, to a terminal end, said second appendage terminal end of one of said first member and said second member wrapping at least partially around said first appendage terminal end of the other of said first member and said second member.

11. The stairway step tread defined in claim 10 wherein said first appendage terminal end has a male part and said second appendage terminal end has a female part, said female part of each of said first member and said second member receiving the male part of the other of said first member and said second member.

12. The stairway step tread defined in claim 8 wherein said first appendage has a male part and said second appendage has a female part, said female part of each of said first member and said second member receiving said male part of the other of said first member and said second member.

* * * * *

UNITED STATES PATENT AND TRADEMARK OFFICE

CERTIFICATE OF CORRECTION

PATENT NO. : 5,349,795

DATED : September 27, 1994

INVENTOR(S) : Terry L. French et al.

It is certified that error appears in the above-indentified patent and that said Letters Patent is hereby corrected as shown below:

On the title page item [54],
Delete "AND METHOD"

Column 4, line 60:
After "spaced" insert --relation--.

Column 8, line 2:
"said male" should be --the male--.

Signed and Sealed this

Sixteenth Day of May, 1995

*Attest:*

*Attesting Officer*

BRUCE LEHMAN

*Commissioner of Patents and Trademarks*